US010179474B2

(12) United States Patent
DeBoer

(10) Patent No.: US 10,179,474 B2
(45) Date of Patent: Jan. 15, 2019

(54) MARKER AND STAMP SYSTEM

(71) Applicant: Matthew DeBoer, Marblehead, MA (US)

(72) Inventor: Matthew DeBoer, Marblehead, MA (US)

( * ) Notice: Subject to any disclaimer, the term of this patent is extended or adjusted under 35 U.S.C. 154(b) by 0 days.

(21) Appl. No.: 15/837,249

(22) Filed: Dec. 11, 2017

(65) Prior Publication Data

US 2018/0272793 A1 Sep. 27, 2018

Related U.S. Application Data

(60) Provisional application No. 62/476,739, filed on Mar. 25, 2017.

(51) Int. Cl.

| | |
|---|---|
| ***B43K 1/00*** | (2006.01) |
| ***B43K 5/02*** | (2006.01) |
| ***B43K 23/12*** | (2006.01) |
| ***B43K 27/08*** | (2006.01) |
| ***B43K 29/00*** | (2006.01) |
| ***B41K 1/00*** | (2006.01) |

(52) U.S. Cl.

CPC ..... *B43K 27/08* (2013.01); *B41K 1/006* (2013.01); *B43K 1/003* (2013.01); *B43K 1/006* (2013.01); *B43K 5/02* (2013.01); *B43K 23/12* (2013.01); *B43K 29/005* (2013.01)

(58) Field of Classification Search

CPC . B41K 1/006; B41K 1/02; B41K 1/04; B41K 1/50; B41K 1/52; B43K 23/06; B43K 27/08; B43K 29/013

See application file for complete search history.

(56) References Cited

U.S. PATENT DOCUMENTS

| | | | | |
|---|---|---|---|---|
| 639,959 | A * | 12/1899 | Becker | B41K 1/02 101/379 |
| 5,826,515 | A * | 10/1998 | Frable | B41K 1/50 101/483 |
| 7,931,417 | B2 * | 4/2011 | Yamamoto | B41K 1/08 401/198 |
| 2008/0250956 | A1 * | 10/2008 | McSweeney | B41K 1/006 101/327 |
| 2011/0303111 | A1 * | 12/2011 | Bolton | B41K 1/04 101/405 |

* cited by examiner

*Primary Examiner* — David P Angwin
*Assistant Examiner* — Bradley S Oliver
(74) *Attorney, Agent, or Firm* — Dunlap Bennett & Ludwig PLLC

(57) ABSTRACT

A marker and stamp system embodied in a double-end device is provided. The device includes a marker end and an opposing stamp end. The stamp end enables the creation of clear and concise group presentations/instructions through the uniform application of predetermined symbols via a stamp applicator portion and marking template, while the marker end facilitates the presentation of tailored, free-hand markings via application of a marker nib.

5 Claims, 3 Drawing Sheets

MARKER AND STAMP SYSTEM

CROSS-REFERENCE TO RELATED APPLICATION

This application claims the benefit of priority of U.S. provisional application No. 62/476,739, filed 25 Mar. 2017, the contents of which are herein incorporated by reference.

BACKGROUND OF THE INVENTION

The present invention relates to markers of non-permanent marker boards and, more particularly, to a marker and stamp system for facilitating non-porous surface presentations, and a method of using the same.

A lack of clarity and neatness in white board presentations has undermined the explanation and education process of such presentations. Which is significant because the context of many of these presentations happens within a time crunch; for example, a sports-related presentation such as during a timeout of a basketball game.

Stamped images tend to provide cleaner and more uniform marks, and thus are better suited for such hasty and stressful presentations. Especially for the standard shapes used in many sports-related presentations, e.g., 'X's and 'O's, free-hand circles can be messy and invite confusion during deadline-driven communications as compared to the predictable efficiency of a stamped circle. Traditional dry erase markers, however, do not and cannot provide the neatness of a stamped image, and currently there are no combined marker and stamp systems.

As can be seen, there is a need for a marker and stamp system for facilitating non-porous surface presentations, and a method of using the same, wherein athletic game procedures, particularly football plays, are diagrammed during sport-related presentations. The current marker and stamp system of the present invention provides a double-ended dry erase marker, enabling uniform application of circular symbols via a stamp end, and the application of free hand marking via a marker end.

SUMMARY OF THE INVENTION

In one aspect of the present invention, a marker and stamp system, includes a device extending from a marker end to an opposing stamp end.

In another aspect of the present invention, the marker and stamp system, includes a device extending from a marker end to an opposing stamp end; a body portion interconnecting the marker and stamp ends; a marker nib extending from the marker end; a marker sleeve extending from the marker end, wherein the marker nib protrudes from a distal end of the marker sleeve; a marking template disposed along the stamp end, wherein the marking template includes a void of a predetermined shape; a tubular stamp nib housed by the body portion so that an applicator portion of the tubular stamp nib protrudes through the marking template; a tubular stamp reservoir in fluid communication with the tubular stamp nib; a marker reservoir fluidly communicating with the marker nib; a nib anchor extending through the lumens of the tubular stamp reservoir and the stamp nib so as to connect to the marker reservoir; and an anchor head perpendicularly joined to a distal end of the anchor so that the anchor head extends through the void of the marking template, further defining the predetermined shape.

These and other features, aspects and advantages of the present invention will become better understood with reference to the following drawings, description and claims.

DETAILED DESCRIPTION OF THE INVENTION

Figure 1:
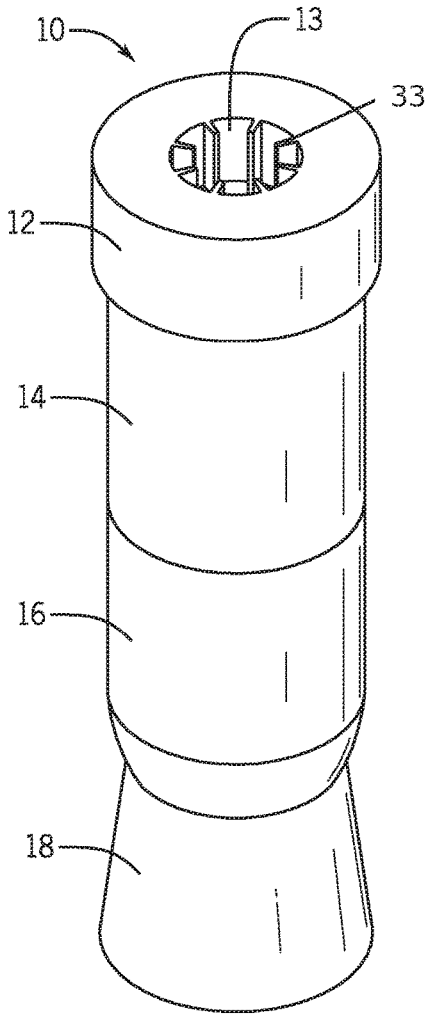
FIG. 1 is a perspective view of an exemplary embodiment of the present invention.
Figure 2:
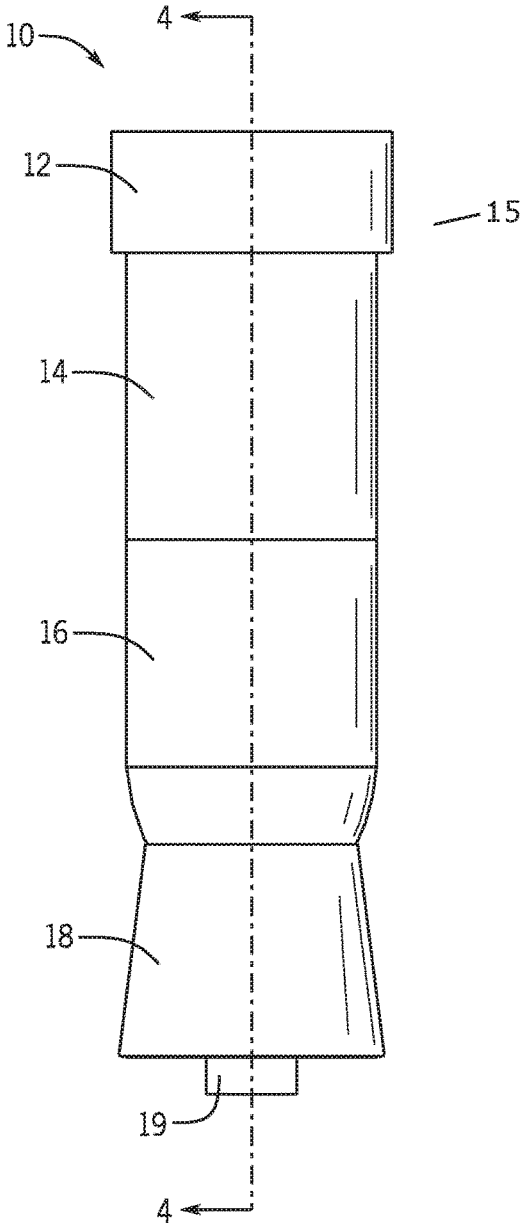
FIG. 2 is an elevation view of an exemplary embodiment of the present invention.
Figure 3:
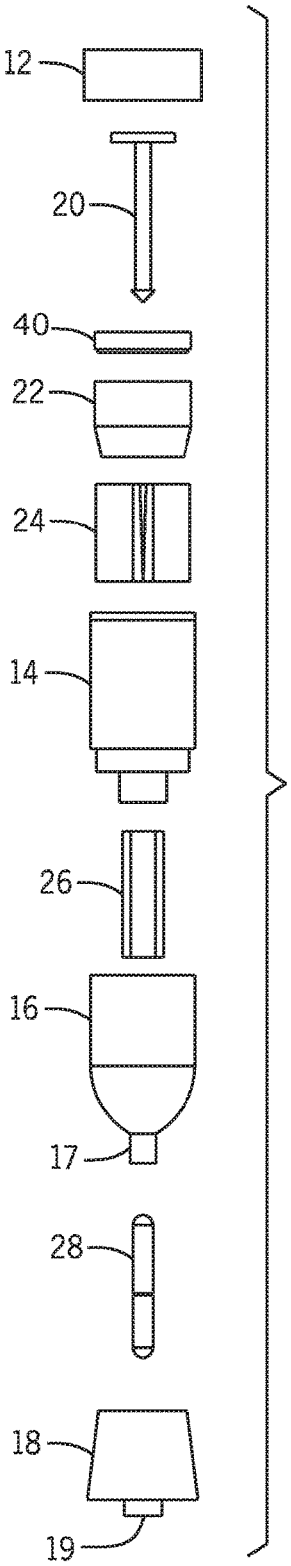
FIG. 3 is an exploded view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a marker and stamp system embodied in a double-end device having a marker end and an opposing stamp end. The stamp end enables the creation of clear and concise group presentations/instructions through the uniform application of predetermined symbols via a stamp applicator portion and operatively associated marking template, while the marker end facilitates tailored free-hand markings via application of a marker nib.

Referring to FIGS. 1 through 6, the present invention may include a marker and stamp system 10 embodied in a device extending between a marker end 11 and a stamp end 15. The marker end 11 includes a marker nib 28 adapted to make a mark on a non-porous surface, such as a white board. The marker nib 28 may protrude from a sleeve 17 extending from the marker end 11. The dimensions of the marker and stamp system 10 may vary; for example, the diameter could be 25 mm, more, or less.

Figure 6:
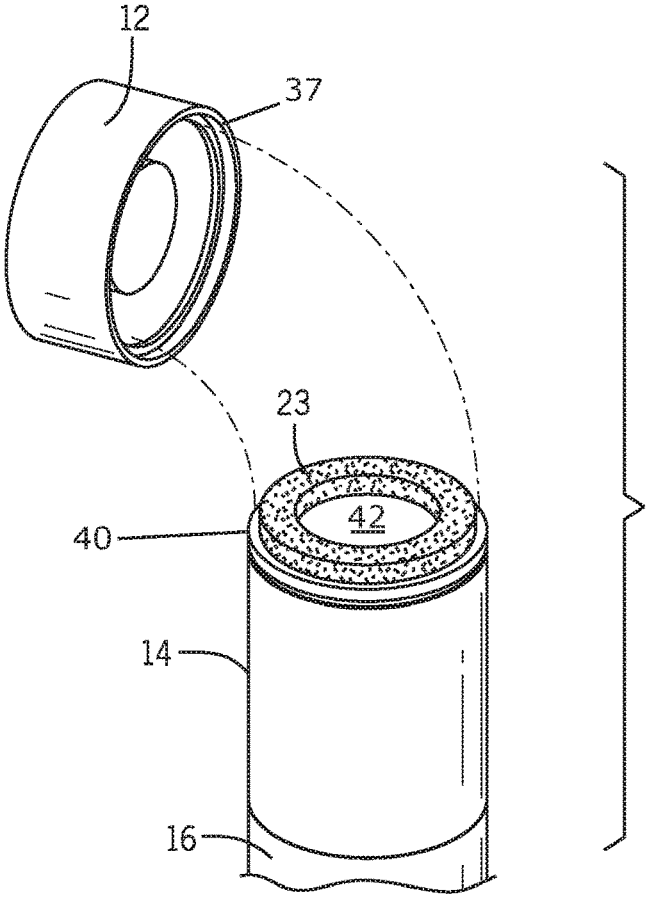
FIG. 6 is a detailed exploded perspective view of an exemplary embodiment of the present invention.

The marker and stamp system 10 may include a stamp cap 12 having a stamp opening 37 dimensioned and adapted to engage the stamp end 15 so as to be movable between a capped condition (see FIG. 1) and an uncapped condition (see FIG. 6). The stamp cap 12 may provide a socket 13 having spaced apart radial flanges 33 extending into the socket opening of the socket 13.

Figure 5:
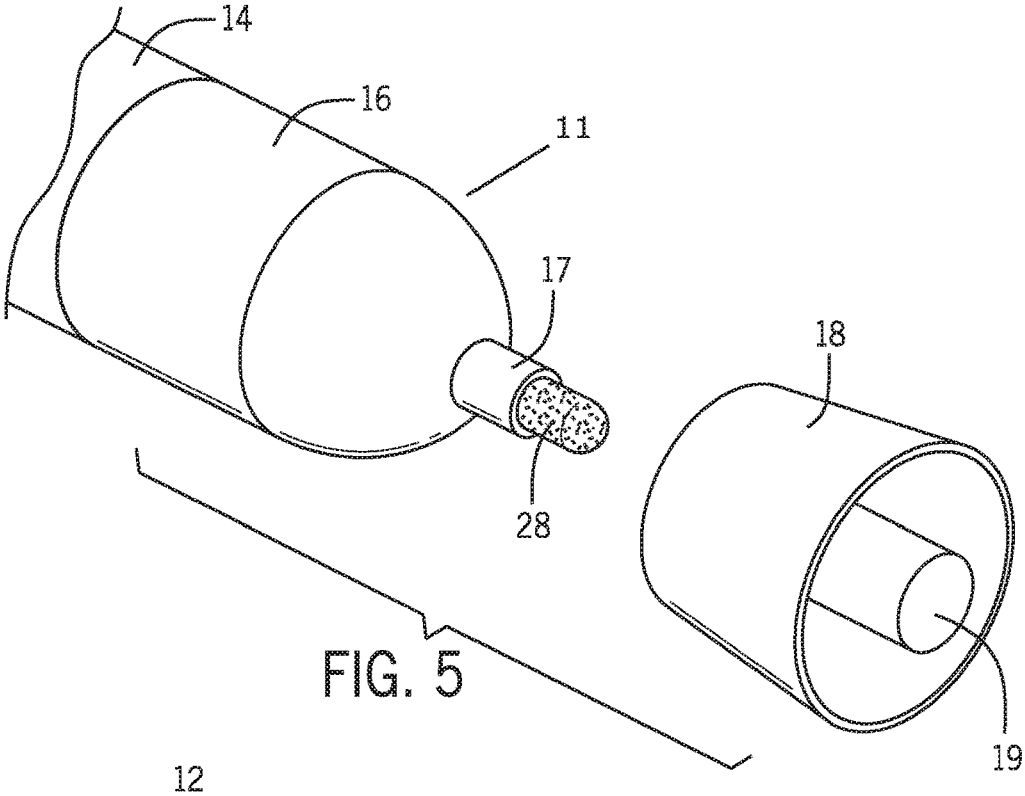
FIG. 5 is a detail exploded perspective view of an exemplary embodiment of the present invention.

The marker and stamp system 10 may include a marker cap 18 having a marker opening 27 dimensioned and adapted to engage the marker end 11 so as to be movable between a capped condition (see FIG. 1) and an uncapped condition (see FIG. 5). The marker opening 27 may be defined by sidewalls 29 having an internal surface dimensioned for engaging the marker end 11, specifically the sleeve 17, through the marker opening 27 to protect the marker nib 28 from drying out when the present invention is not in use. The marker cap 18 may also include a protrusion 19 for engaging the socket 13 for storing the marker cap 18 when the present invention is in use.

Figure 4:
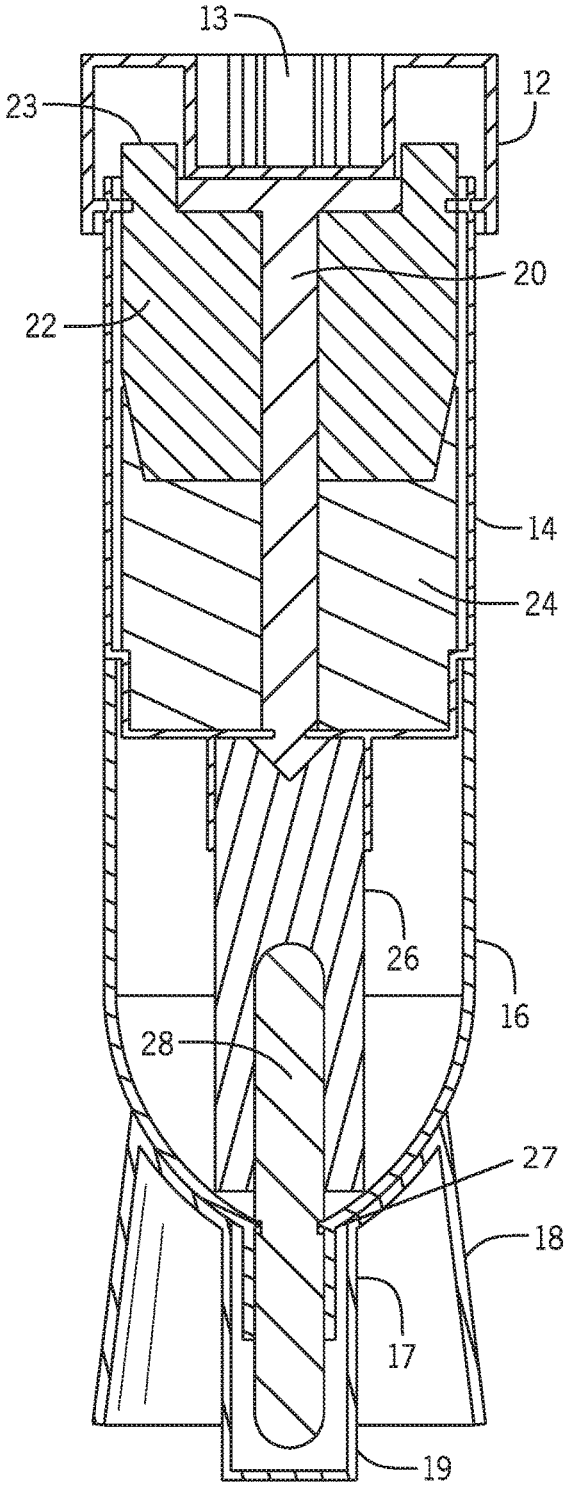
FIG. 4 is a cross-sectional view of an exemplary embodiment of the present invention, taken along line 4-4 of FIG. 2.

The middle section of the marker and stamp system 10 may provide a first body portion 14 and a second body portion 16 interconnecting the stamp end 15 and marker end 11, respectively, as illustrated in FIG. 1. The first body portion 14 houses a tubular stamp nib 22 and an abutting tubular stamp ink reservoir 24 in fluid communication with the tubular stamp nib 22. The tubular stamp nib 22 abuts the stamp end 15 providing a marking template 40 from which an applicator portion 23 of the stamp nib 22 protrudes therefrom so that a user may daub the applicator portion 23. Thereby enabling a user to form a mark in the shape defined by the marking template 40, like a circle shape. As illustrated in FIG. 4, a nib anchor 20 may slide through the lumens of the tubular stamp nib 22 and stamp reservoir 24 so as to secure the same within the first body portion 14. A head 42 of the nib anchor 20 may further define the predetermined shape provided by the marking template 40, in certain examples making the circular shape a 'donut' or 'O' shape.

Housed in the second body portion 16 may be a marker reservoir 26 fluidly communicating with the marker nib 28; in certain embodiments, the marker nib 28 may be embedded in the marker reservoir, as illustrated in FIG. 4. In some embodiments, the nib anchor 20 may connect to the marker reservoir 26 for additional support. Additional inner framework may further support the marker and ink reservoir 26 and 24, as illustrated in FIG. 4. The marker reservoir 26 and the stamp reservoir 24 provide a marking medium such as ink that be fluidly communicated to the marker nib 28 and tubular stamp nib 22, respectively, for conveying said marking medium to a marking surface.

A method of using the present invention may include the following. The marker and stamp system 10 disclosed above may be provided. A user, such as a coach or teacher, may use the double-ended device to create clear and concise group presentations/instructions through the uniform application of circular symbols via the stamp applicator portion 23, as well as tailored free-hand markings via application of the marker nib 28.

It should be understood, of course, that the foregoing relates to exemplary embodiments of the invention and that modifications may be made without departing from the spirit and scope of the invention as set forth in the following claims.

What is claimed is:

1. A marker and stamp system, comprising:

a device extending from a marker end to an opposing stamp end;

a body portion interconnecting the marker and stamp ends;

a marking template disposed along the stamp end, wherein the marking template defines a void of a predetermined shape;

a tubular stamp nib housed by the body portion so that an applicator portion of the tubular stamp nib protrudes through the predetermined shape;

a tubular stamp reservoir in fluid communication with the tubular stamp nib;

a marker reservoir fluidly communicating with the marker nib; and a nib anchor extending through the stamp reservoir and the stamp nib so as to connect to the marker reservoir.

2. The marker and stamp system of claim 1, further comprising a marker nib extending from the marker end.

3. The marker and stamp system of claim 2, further comprising a marker sleeve extending from the marker end, wherein the marker nib protrudes from a distal end of the marker sleeve.

4. The marker and stamp system of claim 1, further comprising an anchor head perpendicularly joined to a distal end of the anchor so that the anchor head extends through the void of the marking template, further defining the predetermined shape.

5. A marker and stamp system, comprising:

a device extending from a marker end to an opposing stamp end;

a body portion interconnecting the marker and stamp ends;

a marker nib extending from the marker end;

a marker sleeve extending from the marker end, wherein the marker nib protrudes from a distal end of the marker sleeve;

a marking template disposed along the stamp end, wherein the marking template includes a void of a predetermined shape;

a tubular stamp nib housed by the body portion so that an applicator portion of the tubular stamp nib protrudes through the marking template;

a tubular stamp reservoir in fluid communication with the tubular stamp nib;

a marker reservoir fluidly communicating with the marker nib;

a nib anchor extending through the stamp reservoir and the stamp nib so as to connect to the marker reservoir; and an anchor head perpendicularly joined to a distal end of the anchor so that the anchor head extends through the void of the marking template, further defining the predetermined shape.

* * * * *